US011607794B2

(12) United States Patent
Andersson

(10) Patent No.: US 11,607,794 B2
(45) Date of Patent: Mar. 21, 2023

(54) POWER WRENCH WITH ADJUSTABLE TRIGGER POSITION

(71) Applicant: ATLAS COPCO INDUSTRIAL TECHNIQUE AB, Stockholm (SE)

(72) Inventor: Patrik Leander Andersson, Skogås (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 426 days.

(21) Appl. No.: 16/621,658

(22) PCT Filed: Jun. 1, 2018

(86) PCT No.: PCT/EP2018/064403
§ 371 (c)(1),
(2) Date: Dec. 11, 2019

(87) PCT Pub. No.: WO2018/228824
PCT Pub. Date: Dec. 20, 2018

(65) Prior Publication Data

US 2021/0187723 A1 Jun. 24, 2021

(30) Foreign Application Priority Data

Jun. 12, 2017 (SE) ..... 1730158-1

(51) Int. Cl.
*B25F 5/02* (2006.01)
*B25B 23/00* (2006.01)
*B25B 21/00* (2006.01)

(52) U.S. Cl.
CPC ..... *B25F 5/021* (2013.01); *B25B 21/00* (2013.01); *B25B 21/002* (2013.01); *B25B 23/0028* (2013.01); *B25F 5/02* (2013.01)

(58) Field of Classification Search
CPC ..... B25F 5/021; B25F 5/02; B25B 21/00; B25B 21/02; B25B 21/002; B25B 23/00;
(Continued)

(56) References Cited

U.S. PATENT DOCUMENTS 3,328,184 A 6/1967 Weber
3,329,185 A * 7/1967 Hettich ..... B25B 21/00 173/217
5,577,425 A 11/1996 Holmin et al.
(Continued)

FOREIGN PATENT DOCUMENTS

CN 202862165 U 4/2013
DE 102013218190 A1 3/2015
(Continued)

OTHER PUBLICATIONS

International Search Report (ISR) and Written Opinion dated Sep. 17, 2018, issued in International Application No. PCT/EP2018/064405.
(Continued)

*Primary Examiner* — Robert J Scruggs
(74) *Attorney, Agent, or Firm* — Holtz, Holtz & Volek PC

(57) ABSTRACT

A power wrench includes a cylindrical housing, an electric motor, an output shaft connected to the motor and a power switching device activated by a trigger located on the housing. The trigger is supported on an annular sleeve element coaxially disposed and rotatable relative to the housing for enabling adjustment of the angular position of the trigger relative to the housing. Irrespective of its angular position the trigger is arranged to axially displace a non-rotatable activation ring to activate the power switching device. The housing includes an adjustable angle head supporting the output shaft and arranged to be set in alternative angular positions relative to the housing.

11 Claims, 3 Drawing Sheets

(58) Field of Classification Search
CPC ..... B25B 23/0028; B25B 23/0064; B25B 23/10; B25B 23/16; B25B 13/481; B25B 13/505; B23P 19/06
See application file for complete search history.

(56) References Cited

U.S. PATENT DOCUMENTS

| | | | | |
|---|---|---|---|---|
| 8,276,685 | B2 | 10/2012 | Hozumi et al. | |
| 2004/0089528 | A1* | 5/2004 | Totsu | B25B 23/14 200/293.1 |
| 2007/0084310 | A1* | 4/2007 | Kobayashi | B25B 21/00 81/57.39 |
| 2009/0126960 | A1 | 5/2009 | Radif | |
| 2010/0163265 | A1* | 7/2010 | Hozumi | B25B 21/00 173/217 |
| 2010/0229691 | A1 | 9/2010 | Braendstroem et al. | |
| 2011/0259619 | A1 | 10/2011 | Brodin | |
| 2014/0133898 | A1 | 5/2014 | Tussing | |
| 2016/0288304 | A1 | 10/2016 | Shiao | |

FOREIGN PATENT DOCUMENTS

| | | | |
|---|---|---|---|
| EP | 0691185 | A1 | 1/1996 |
| EP | 2202035 | A2 | 6/2010 |
| EP | 2367658 | A1 | 9/2011 |
| JP | 2007105869 | A | 4/2007 |
| JP | 2011093007 | A | 5/2011 |
| JP | WO 2011052260 | * | 5/2011 |
| WO | 2007129957 | A1 | 11/2007 |
| WO | 2009051543 | A1 | 4/2009 |

OTHER PUBLICATIONS

Office Action (Non-Final Rejection) dated Sep. 2, 2021 issued in related U.S. Appl. No. 16/621,668.

Related U.S. Appl. No. 16/621,668, First Named Inventor: Patrik Leander Andersson; Title: "Power Wrench With Angle Drive"; filed Dec. 11, 2019.

International Search Report (ISR) and Written Opinion dated Oct. 1, 2018, issued in International Application No. PCT/EP2018/064403.

Chinese Office Action dated Jun. 1, 2022 (and English translation thereof) issued in Chinese Application No. 201880038407.X.

Notice of Allowance dated Nov. 24, 2021, issued in related U.S. Appl. No. 16/621,668.

Japanese Office Action dated May 30, 2022 (and English translation thereof) issued in Japanese Application No. 2019-568321.

* cited by examiner

POWER WRENCH WITH ADJUSTABLE TRIGGER POSITION

The invention relates to a power wrench comprising a cylindrical housing, a motor, and an angle head supported on the housing and including a laterally extending output shaft. The housing is understood to be cylindrical in its entirety or cylindrical in those areas where needed to facilitate the use and function of the adjustable trigger.

In many power wrench applications the operator faces a problem with awkward working postures for obtaining a proper position of the wrench to screw joints to be tightened. At power wrenches having a power controlling trigger supported on the housing such situations may be aggravated by the position of the trigger on the housing in relation to the angular position of the angle head and, hence, the direction of the output shaft. This may necessitate the operator to take an even more awkward posture to be able to support the wrench properly and at the same time be able to manoeuver the trigger. Accordingly, the relative trigger and angle head positions on the housing may cause an undesirable working situation from an ergonomic point of view.

This problem is evident in screw joint tightening operations where the screw joint is located in a difficult to reach position wherein the angle head has to be adjusted to have the output shaft directed so as to avoid parts of the wrench housing getting into contact with the structure on which the screw joint is situated, thereby obstructing the wrench from reaching a proper operating position. In such cases the trigger may end up in a position where it is awkward for the operator to manoeuver the trigger without taking an uncomfortable and tiresome posture.

It is an object of the invention to provide a power wrench having a cylindrical housing mounted power control trigger and an angle head with a laterally extending output shaft, and by which the problem of awkward and tiresome operator postures at power wrench operations is mitigated.

It is a further object of the invention to provide a power wrench having a cylindrical housing, power control trigger mounted on the housing and an angle head with a laterally extending output shaft and by which the operator working postures are ergonomically improved.

It is still another object of the invention to provide a power wrench having a cylindrical housing, an angle head attached to the housing and having a laterally extending output shaft and by which the accessibility of the wrench at difficult to reach screw joint positions is improved.

The above objects of the invention related to awkward operator postures is reached by providing a power wrench having a cylindrical housing, a motor, a power controlling trigger supported on the housing, and an angle head with a laterally extending output shaft, wherein the position of trigger is adjustable relative to the housing and the output shaft.

The other of the above objects of the invention related to accessibility of the wrench is reached by providing a power wrench having a cylindrical housing, a motor, and an angle head with a laterally extending output shaft, wherein the angle head position is adjustable to obtain different angular positions of the output shaft in relation to the housing.

Still further objects and advantages of the invention will appear from the following specification and drawings.

A preferred embodiment of the invention is described below with reference to the accompanying drawings.

In the drawings

Figure 1:
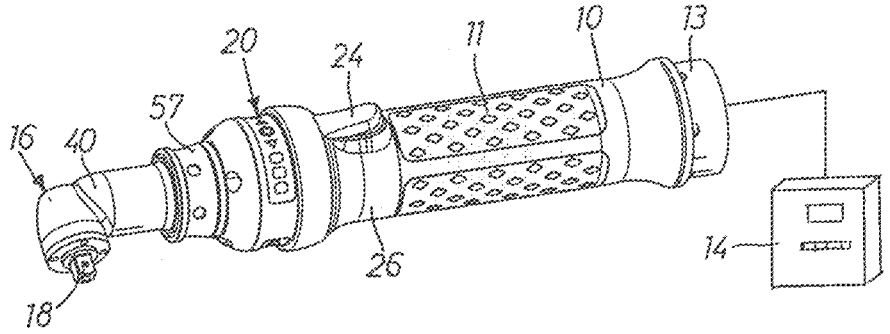
FIG. 1 shows a perspective view of a power wrench according to one embodiment of the invention.

The power wrench illustrated in FIG. 1 comprises a cylindrical housing 10 formed with a tubular handle 11 and supporting a non-illustrated electric motor. At its rear end the housing 10 provided with a connection socket 13 for connection of a power and signal transferring cable communicating with a separate programmable operation control unit 14. The properties and operation order of the control unit is of a well known type and does form any part of the present invention. Therefore, it is not illustrated in further detail.

At its forward end the housing 10 carries an angle head 16 with a square ended output shaft 18 adapted to carry a nut socket. The output shaft 18 extends in a lateral direction perpendicularly to the cylindrical housing 10 and is connected to the motor via an angle drive. The angle head 16 is connected to the housing 10 via a swivel coupling 20 for enabling setting of the angle head 16 in a number of alternative angular positions relative to the housing 10 such that the output shaft 18 may be directed in alternative angular dispositions relative to the housing 10.

A trigger 24 is provided on the housing 10 for manual control of the power supply to the motor. The trigger 24 is carried by an annular sleeve element 26 which is freely rotatable relative to the housing 10. By provision of the trigger 24 on a rotatable sleeve element 26 it is possible to rotate the trigger 24 into angular positions favourable for manoeuvring the trigger 24 also in awkward operation positions, especially with reference to the actual angular position of the angle head 16.

Figure 3:
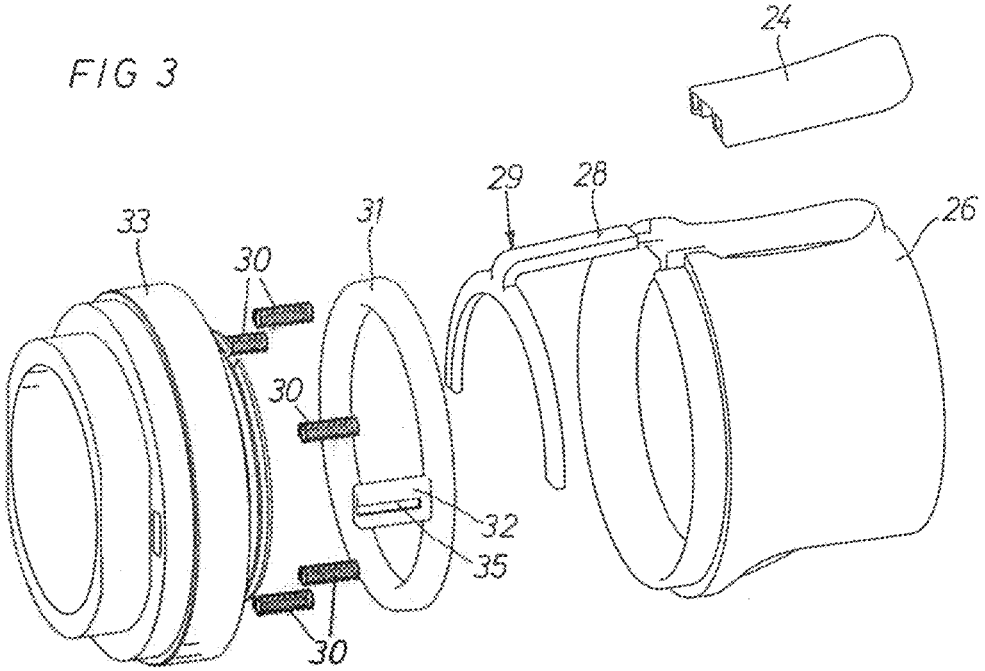
FIG. 3 shows on a larger scale an exploded view of a trigger arrangement according to the invention.
Figure 4:
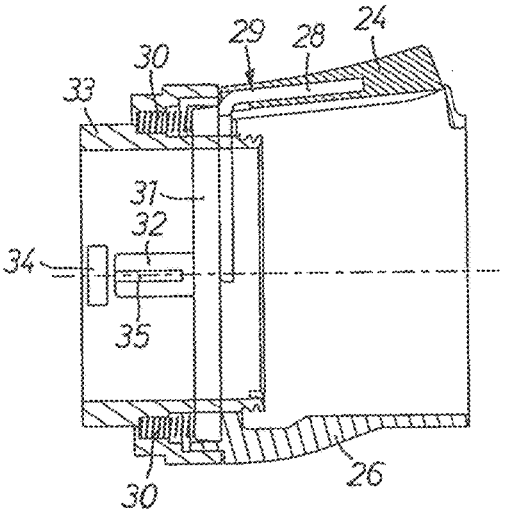
FIG. 4 shows a longitudinal section of an assembled trigger arrangement of FIG. 3 illustrating an inactive position of the trigger.
Figure 5:
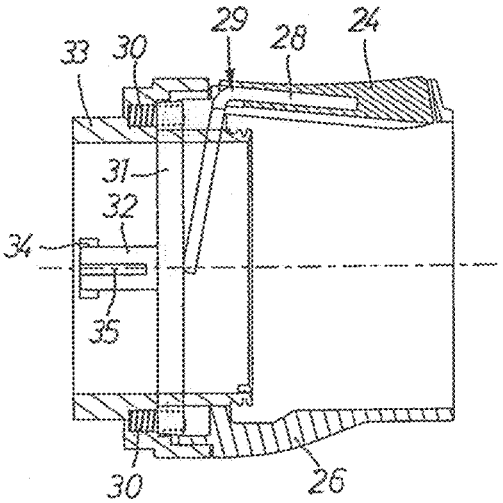
FIG. 5 shows a similar section as FIG. 4 but illustrates the trigger in its activated position.
Figure 6:
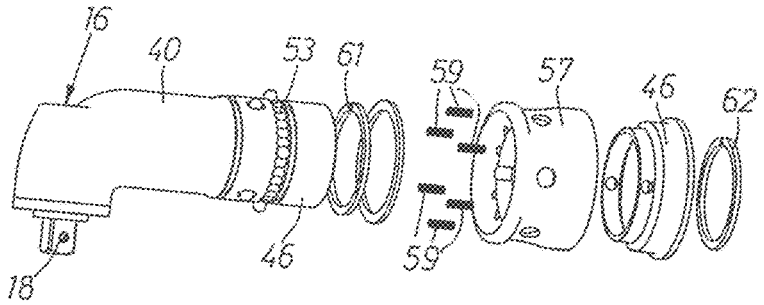
FIG. 6 shows an exploded perspective view of an angle head arrangement according to the invention.
Figure 7:
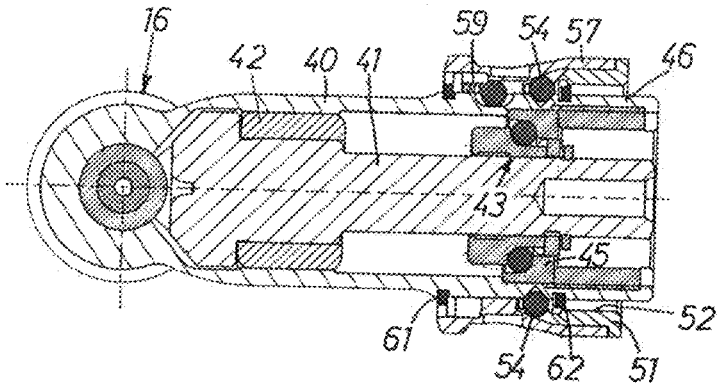
FIG. 7 shows a longitudinal section of the angle head in FIG. 6 illustrating a lock position of the angle head locking device.
Figure 8:
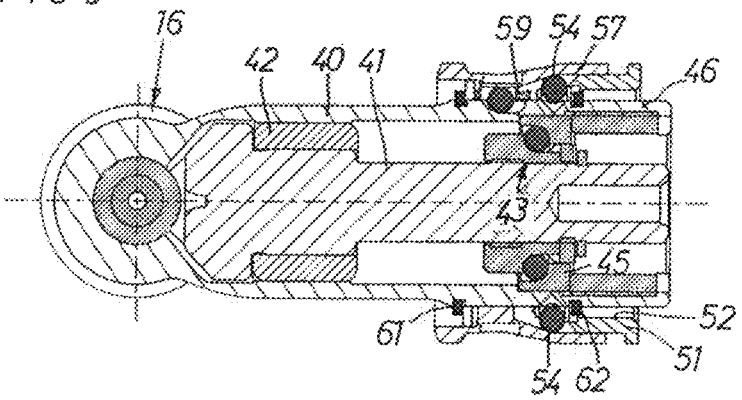
FIG. 8 shows a similar section as FIG. 7 but illustrates a release position of the angle head locking device.
Figure 9:
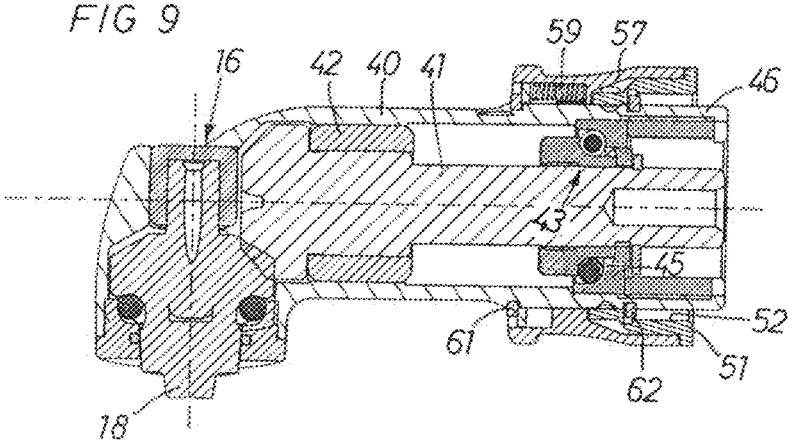
FIG. 9 shows an alternative section of the angle head illustrated in FIGS. 6-8.

As illustrated in FIGS. 3-5 the trigger 24 is mounted on an arm 28 of a fork 29 which is pivotally supported on the sleeve element 26. The fork 29 is arranged to cooperate with an activation ring 31 coaxial with the housing 10 and formed with an axially protruding finger 32. The activation ring 31 is supported on and axially displaceable relative to a support sleeve 33 secured in the housing 10, and springs 30 are provided to bias the activation ring 31 towards a rear inactivated position. The support sleeve 33 carries a Hall element 34 acting as an activation means for accomplishing shifting of a non-illustrated power switching device, wherein activation of the Hall element 34 is accomplished by a magnet 35 carried on the finger 32 of the activation ring 31.

In FIG. 4 the trigger 24 as well as the activation ring 31 are illustrated in their rest positions retracted by the springs 30. In this position of the activation ring 31 the magnet 35 is out of cooperation with the Hall element 34 and no signal is emitted to activate the power switch.

In FIG. 5 the trigger 24 has been pressed down to an activated position thereby making the fork 29 displace the activation ring 31 forwards to a position where the Hall element 34 is activated by the magnet 35. This results in a signal being emitted by the Hall element 34 to activate the power switching device and start the wrench for operation.

The activation ring 31 is not rotatable relative to the housing 10 but has a fixed annular position with the finger 32 in constant position for cooperation with the Hall element 34. The annular sleeve element 26 on which the trigger 24 is supported is freely rotatable relative to the housing 10, but due to the arrangement with the trigger 24 mounted on the fork 29 the activation ring 31 may be displaced into its active position independently of the actual angular position of the trigger 24.

The angle head 16 carried at the forward end of the housing 10 comprises a casing 40 wherein a drive pinion 41 and the output shaft 18 are journalled. The drive pinion 41 is supported in a forward bearing 42 and a rear bearing 43, whereof the rear bearing 43 is a ball bearing with an outer race 45 is supported in a tubular neck portion 46 of the angle head casing 40.

Figure 2:
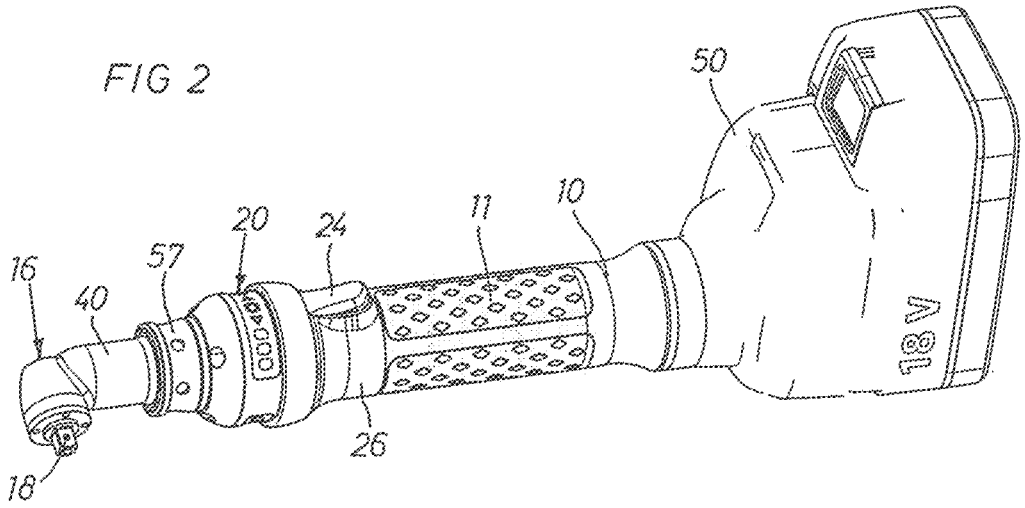
FIG. 2 shows a perspective view of a power wrench according to an alternative embodiment of the invention.

In FIG. 2 there is illustrated a battery powered power wrench wherein the rather bulky battery package 50, although it makes the wrench freely movable without cable connection, still causes occasional problems at getting access to difficult to reach screw joint locations. In this type of wrenches there is a particular need for having the angle head 16 adjustable to get a favourable direction of the output shaft 18. In a less favourable direction of the output shaft 18 there is a risk that the battery package will get into contact with the structure adjacent the screw joint to be tightened and obstruct a proper wrench position.

Accordingly, it is an advantage to have the angle head 16 rotatable and possible to be set in alternative angular positions relative to the housing 10. As illustrated in FIGS. 6-9 the neck portion 46 of the angle head casing 40 is freely rotatable relative to a mounting sleeve 51 which is rigidly connected to the wrench housing 10 via an inner thread 52. The neck portion 46 is provided with a row of indentations 53 distributed around its periphery, and a couple of balls 54 are provided to engage those indentations 53. This ball/indentation arrangement forms a locking device 55 by which the angle head 16 is lockable in alternative angular positions relative to the housing 10. The balls 54 are radially movable within apertures 56 in the mounting sleeve 51, and a surrounding manoeuver sleeve 57 is axially displaceable between a rear lock position in which the balls 54 are blocked from leaving the indentations 53 and a release position wherein the balls 54 are free to move out of the indentations 53 and unlock the angle head 16 for rotation relative to the mounting sleeve 51 and the housing 10. A number of springs 59 are provided to exert a bias force on the manoeuver sleeve 57 towards the lock position. The axial movability of the manoeuver sleeve 57 is limited by two lock rings 61, 62 mounted on the neck portion 46 of the angle head casing 40.

When it becomes necessary to change the angular position of the angle head 16 relative to the housing 10 to thereby facilitate accessibility to difficult to reach screw joint locations the manoeuver sleeve 51 is pulled forwardly against the bias force of the springs 59 wherein the balls 54 are free to leave their locking engagement with the indentations 53. Now the angle head 16 is unlocked relative to the housing 10 and could be rotated to a desired angular position. When that is done the manoeuver sleeve 51 is allowed to return to its lock position by the force of the springs 59, wherein the balls 54 reengage the indentations 53 and lock the angle head 10 against rotation.

By the trigger arrangement according to the invention there is provided a power wrench by which the operator is offered the possibility to easily readily adapt the wrench to various working conditions and avoid awkward and tiresome working postures.

It is to be understood that the embodiments of the invention are not limited to the described and illustrated examples but may be freely varied within the scope of the claims.

The invention claimed is:

1. A power wrench comprising:

a cylindrical housing;

an electric motor;

an output shaft connected to the motor; and a power switching device activated by a trigger located on the housing, wherein the trigger is supported on an annular sleeve element, and the sleeve element is supported in a coaxial disposition and rotatable relative to the housing to enable adjustment of an angular position of the trigger relative to the housing, wherein the trigger is arranged to activate the power switching device via an axially displaceable activation ring, and wherein the trigger is arranged to accomplish displacement of the activation ring via a fork.

2. The power wrench according to claim 1, wherein the power switching device includes a Hall element arranged to be activated by a magnet supported by the activation ring.

3. The power wrench according to claim 2, wherein an angle head is attached to the housing and supports the output shaft in a laterally extending position, and wherein the angle head is connected to the housing via a swivel coupling to enable rotation of the angle head and adjustment of an angular position of the output shaft relative to the housing.

4. The power wrench according to claim 3, wherein a locking device is arranged between the angle head and the housing for arresting the angle head in alternative angular positions relative to the housing.

5. The power wrench according to claim 4, wherein the locking device comprises a maneuver sleeve that is manually shiftable between a lock position and a release position, and at least one spring arranged to bias the maneuver sleeve towards the lock position.

6. The power wrench according to claim 1, wherein an angle head is attached to the housing and supports the output shaft in a laterally extending position, and wherein the angle head is connected to the housing via a swivel coupling to enable rotation of the angle head and adjustment of an angular position of the output shaft relative to the housing.

7. The power wrench according to claim 6, wherein a locking device is arranged between the angle head and the housing for arresting the angle head in alternative angular positions relative to the housing.

8. The power wrench according to claim 7, wherein the locking device comprises a maneuver sleeve that is manually shiftable between a lock position and a release position, and at least one spring arranged to bias the maneuver sleeve towards the lock position.

9. A power wrench comprising:

a cylindrical housing;

an electric motor;

an output shaft connected to the motor;

an angle head which is attached to the housing and supports the output shaft in a laterally extending position; and a power switching device activated by a trigger located on the housing, wherein the trigger is supported on an annular sleeve element, and the sleeve element is supported in a coaxial disposition and rotatable relative to the housing to enable adjustment of an angular position of the trigger relative to the housing, wherein the angle head is connected to the housing via a swivel coupling to enable rotation of the angle head and adjustment of an angular position of the output shaft relative to the housing, wherein the angular position of the trigger relative to the housing is adjustable independently of rotation of the angle head, and wherein the trigger is arranged to activate the power switching device via an axially displaceable activation ring.

10. The power wrench according to claim 9, wherein a locking device is arranged between the angle head and the housing for arresting the angle head in alternative angular positions relative to the housing.

11. The power wrench according to claim 10, wherein the locking device comprises a maneuver sleeve that is manually shiftable between a lock position and a release position, and at least one spring arranged to bias the maneuver sleeve towards the lock position.

* * * * *